United States Patent [19]

Lilienthal

[11] Patent Number: 4,907,357

[45] Date of Patent: Mar. 13, 1990

[54] SNOW PLOW ASSEMBLY ADAPTED FOR MOUNTING ON A VEHICLE AND METHOD OF USING THE SAME

[76] Inventor: Scott C. Lilienthal, P.O. Box 3232, Vail, Colo. 81658

[21] Appl. No.: 159,673

[22] Filed: Feb. 24, 1988

[51] Int. Cl.[4] ..... E01H 4/00

[52] U.S. Cl. ..... 37/197; 37/236; 37/266; 37/268; 37/DIG. 3; 172/830; 172/831

[58] Field of Search ..... 37/195, 197, 266–269, 37/279, DIG. 3, 235; 172/828, 830, 831

[56] References Cited

U.S. PATENT DOCUMENTS

| | | | |
|---|---|---|---|
| 2,548,461 | 4/1951 | Arps | 37/DIG. 3 |
| 3,302,317 | 2/1967 | Domries | 37/268 |
| 3,776,318 | 12/1973 | Layton | 37/DIG. 3 |
| 3,800,447 | 4/1974 | Harvey | 37/268 |
| 4,587,750 | 4/1986 | Larson | 37/266 |

FOREIGN PATENT DOCUMENTS

| | | | |
|---|---|---|---|
| 682594 | 3/1964 | Canada | 37/DIG. 3 |
| 2042926 | 10/1978 | Fed. Rep. of Germany | 37/279 |

*Primary Examiner*—Eugene H. Eickholt

[57] ABSTRACT

A snow plow assembly adapted for mounting on a vehicle. The snowplow assembly includes a conventional blade mounted on the front of the vehicle and powered with conventional hydraulic systems. The snow plow assembly also includes a blade mounted on the rear of the vehicle which may be raised or lowered and maintained in a selected position by hydraulic ram and which may be tilted in pitch. Diverter switches permit the vehicle operator to selectively use a single control for either changing the angle of the front plow in a horizontal plane or either for raising or lowering the rear blade or for tilting the pitch of the rear blade. Thus, the snow plow assembly can readily be adapted and retrofitted on vehicles possessing conventional front blades. A method of using the snow plow assembly is also disclosed.

19 Claims, 3 Drawing Sheets

SNOW PLOW ASSEMBLY ADAPTED FOR MOUNTING ON A VEHICLE AND METHOD OF USING THE SAME

BACKGROUND OF THE INVENTION

Most conventional snow plows used for removing snow from a parking lot, driveway, or the like utilize a steel plow or blade mounted on the front of a pick-up truck or similar vehicle. Such blades are typically curved with a concave front surface so that when the truck travels in a forward direction, the snow is tossed in front and to the side of the blade. These blades are typically mounted on hydraulic rams which are capable of raising and lowering the blade and maintaining the blade in a selected vertical position as well as angling the blade in a horizontal plane so that the snow may be deposited selectively toward the left side or toward the right side of the vehicle. The pitch or tilt of the blade conventionally is fixed.

The foregoing type of snow plow suffers a disadvantage when used to plow driveways leading to a garage or similar building. If the vehicle is backed along the driveway until near the garage, the plow is lowered, and the vehicle is driven in a forward direction, then there will be a portion of the driveway near the garage of approximately the length of the vehicle from which the snow has not been removed. On the other hand, if the vehicle is driven forwardly along the driveway to a point adjacent to the garage, the blade is lowered, and the vehicle is backed out of the driveway, then the shape of the plow results in a very inefficient removal of snow from the driveway, only a single reverse drive gear (as opposed to several different forward drive gears) can be used, and the driver encounters a visibility problem when backing from the driveway into the road. The disadvantages of using a conventional front blade near a garage are compounded in those regions where snow frequently slides down a roof above the garage and piles (and compresses) near the garage entrance. These snow plows encounter similar problems when removing snow from parking lots, especially in the areas near entrance ways and walkways to stores and similar facilities adjoining the parking lot.

SUMMARY OF THE INVENTION

The present invention relates to a snow plow assembly adapted for mounting on a vehicle. The snowplow assembly includes a conventional blade mounted on the front of the vehicle and powered with conventional hydraulic systems. The snow plow assembly also includes a blade mounted on the rear of the vehicle which may be raised or lowered and maintained in a selected position by a hydraulic ram and which may be tilted in pitch. Diverter switches permit the vehicle operator to selectively use a single control for either changing the angle of the front blade in a horizontal plane or either for raising or lowering the rear blade or for tilting the pitch of the rear blade. Thus, the snow plow assembly can readily be adapted and retrofitted on vehicles possessing conventional front blades. A method of using the snow plow assembly is also disclosed.

BRIEF DESCRIPTION OF THE DRAWINGS

The invention will now be described with reference to the accompanying drawings wherein.

BRIEF DESCRIPTION OF THE PREFERRED EMBODIMENT

Figure 1:
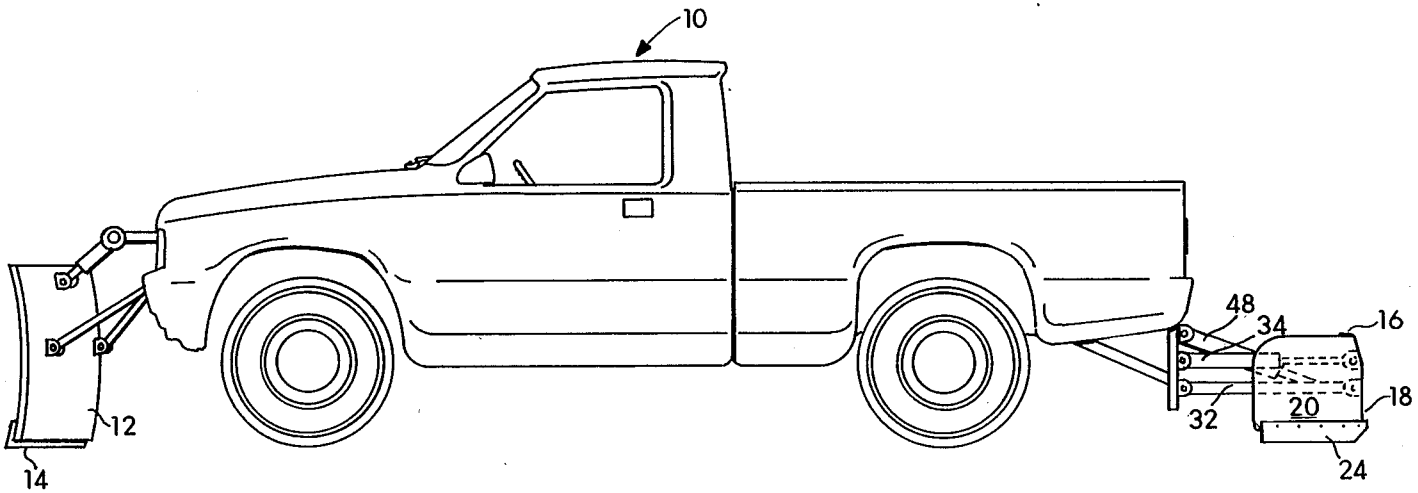
FIG. 1 is a plan, side view of a pick-up truck possessing a snow plow assembly in accordance with the present invention.
Figure 2:
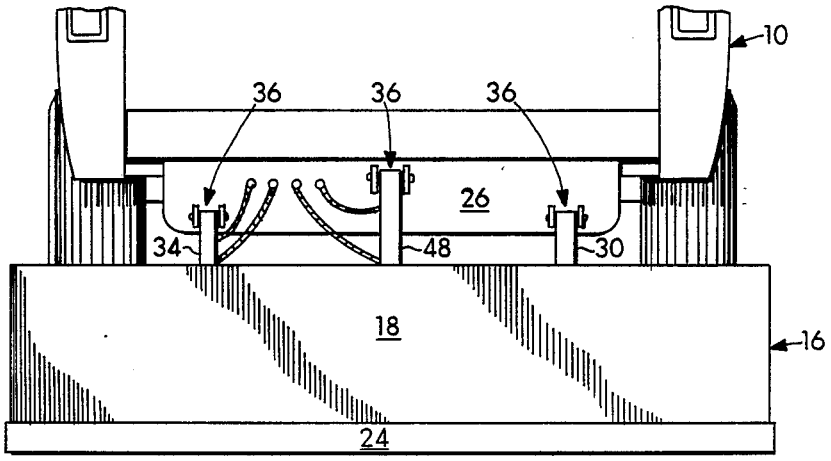
FIG. 2 is a plan, rear end view of the rear end of the vehicle and snow plow assembly shown in FIG. 1.

The invention will now be described with reference to the accompanying drawings wherein like reference numerals refer to the same item. There is shown in FIG. 1 a snow plow assembly according to the present invention. The snow plow assembly is adapted for use with a vehicle such as a pick-up truck 10. A conventional front plow or blade 12 is mounted on the front of the pick-up truck 10 by means of conventional, pivoted mounting rods and hydraulic rams. The front surface of the front blade 12 is substantially concave in shape so as to push snow forwardly and to the side of the front blade 12 when the pick-up truck 10 is driven in a forward direction. The forward surface of the bottom edge of the front blade 12 may be provided with a wear plate 14 appropriately secured such as by bolts to the front blade 12. A conventional hydraulic system operable by means of control switches located in the cab of the pick-up truck 10 may be used to raise and lower the front blade 12 and to maintain the front blade 12 in a selected vertical position as well as to rotate the front blade 12 at a selected angle in a horizontal plane so that the snow can be selectively deposited on the left or the right side of the pick-up truck 10. Typically, the cab controls include two manually operable, three-way switches—one switch for raising, lowering, and maintaining the vertical position of the front blade 12, and the other switch for rotating the front blade 12 in a clockwise direction in a horizontal plane, for rotating the front blade 12 in a counter-clockwise direction in a horizontal plane, and for maintaining the angle of the front blade 12.

Figure 3:
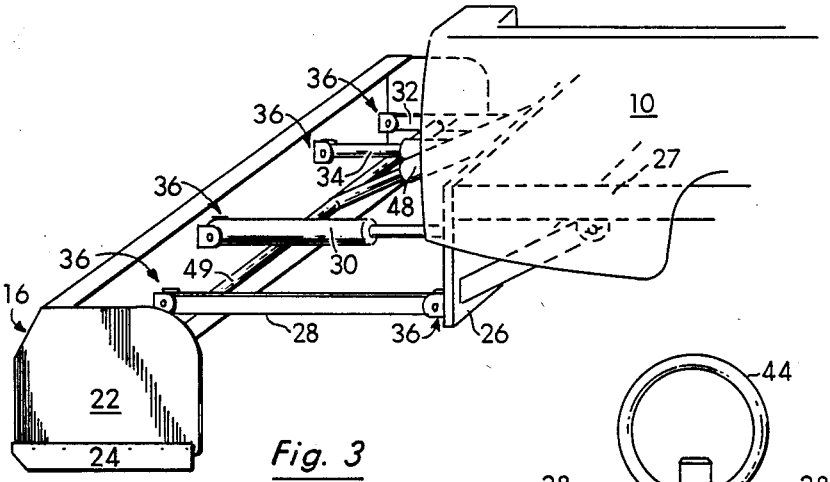
FIG. 3 is a perspective view of the rear end of the vehicle and the snow plow assembly.
Figure 4:
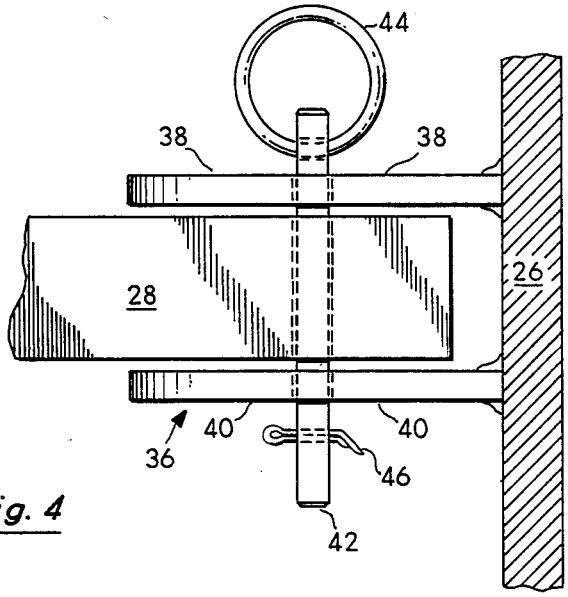
FIG. 4 is a schematic illustration of the mounting bracket assembly used in mounting the rear blade to the vehicle.
Figure 5:
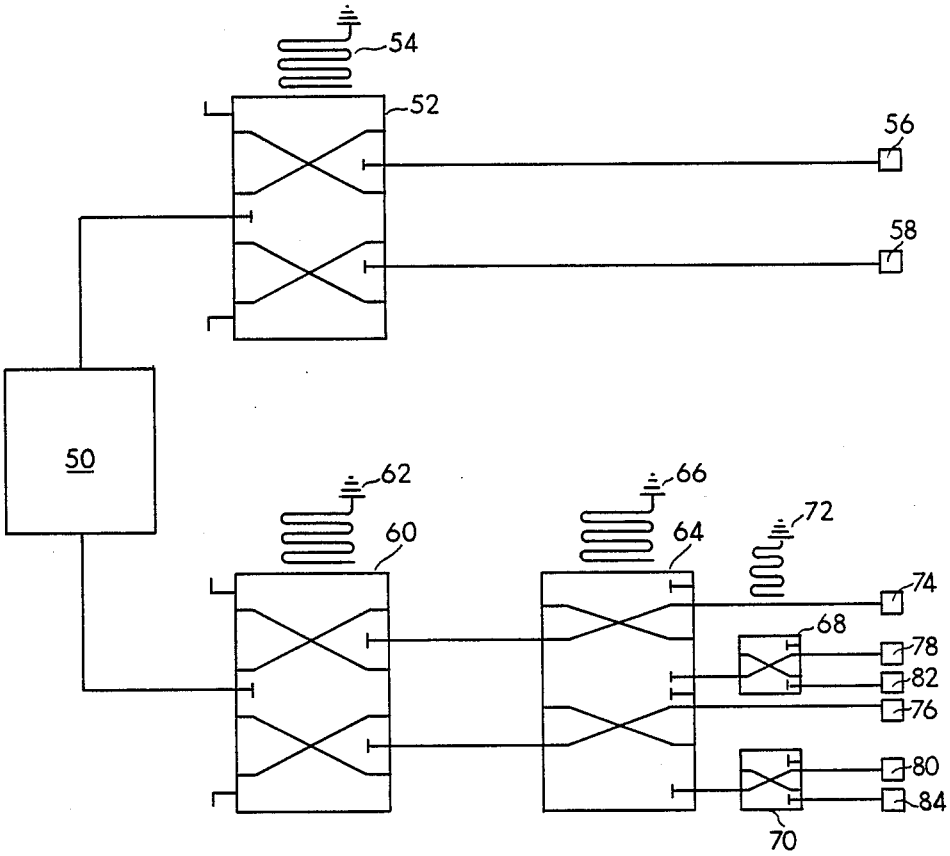
FIG. 5 is a schematic diagram of the hydraulic system used to position the front blade and the rear blade of the snow plow assembly.

The snow plow assembly of the present invention also includes a rear plow or blade 16 as best shown in FIGS. 1, 4, and 5. The rear blade 16 includes a generally flat, central, upstanding section 18 oriented substantially perpendicular to the direction of travel of the pick-up truck 10 and includes a pair of side walls 20, 22 mounted at and forwardly of the central upstanding section 18. Preferably the central upstanding section 18 is oriented a few degrees from the perpendicular so the rear blade 16 is better able to shave ice and hard packed snow. The central upstanding section 18 is generally concave in shape. A wear plate 24 may be riveted or the like to the exterior surface at the bottom edge of the rear blade 16. The lower edge of the wear plate 24 adjacent to the central upstanding section 18 is beveled, as best shown in FIGS. 1 and 3.

In order to mount the rear blade 16 on to the rear of the pick-up truck 10, a steel mounting plate 26 is firmly secured by bolting and welding to the rear of the frame 27 of the pick-up truck 10. Two mounting rods 28, 32, extend between the mounting plate 26 and the central upstanding section 18 of the rear blade 16. A telescoping steel rod and tube assembly 30 extends between the mounting plate 26 and the central upstanding section 18 of the rear blade 16 and is vertically disposed above the mounting rod 28. A hydraulic ram 34 extends between the mounting plate 26 and the central upstanding section 18 of the rear blade 16 and is vertically disposed about the mounting rod 32. When the hydraulic ram 34 is extended, the rear blade 16 rotates (tilts in pitch) in a counter-clockwise direction as viewed in FIG. 3, and when the hydraulic ram is retracted, the rear blade 16 rotates in a clockwise direction as viewed in FIG. 3.

A hydraulic ram 48 is pivotably secured at one end to the mounting plate 26 by means of a mounting bracket assembly 36 and pivotably secured at its other end to a cross bar 49 connected to and extending between the mounting rods 28, 32 also by means of a mounting bracket assembly 36. When the hydraulic ram 48 is extended, the rear blade 16 is lowered, and conversely, when the hydraulic ram 48 is retracted, the rear blade 16 is raised.

Figure 6:
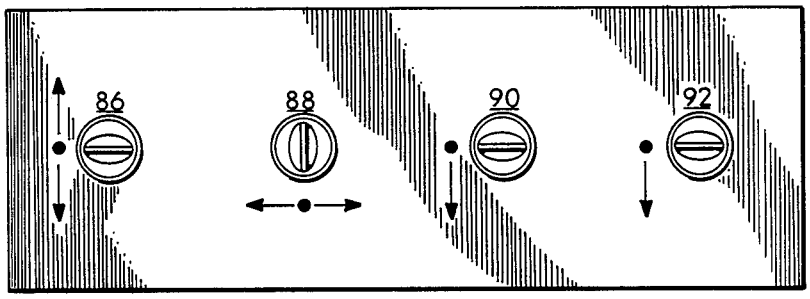
FIG. 6 is a schematic illustration of a control panel used to operate the hydraulic system depicted in FIG. 5.

One end of each mounting rod 28, 32, is pivotably connected to the mounting plate 26 by means of a mounting bracket assembly 36, as best shown in FIG. 6. The other end of each mounting rod 28, 32, is pivotably mounted through a substantially identical mounting bracket assembly 36 to the central upstanding section 18 of the rear blade 16. The opposing ends of the telescoping rod and tube assembly 30 and the opposing ends of the hydraulic rams 34, 48 are also pivotably mounted in a likewise manner.

Each mounting bracket assembly 36 includes a clevis comprising a pair of substantially semi-circular plates 38, 40 mounted by bolts or welding to the mounting plate 26 (or the central upstanding section 18). A bolt 42 selectively extends through aligned apertures in the semi-circular plates 38, 40 of the clevis and through a corresponding borehole laterally extending through the end of the corresponding mounting rod 28, 32. One end of the bolt 42 is provided with a ring handle 44 adapted to be grasped for pulling the bolt 42 away from its seating in the clevis. A retaining pin 46 extends through and may be selectively disposed within a borehole laterally extending through the other end of the bolt 42 for selectively maintaining the bolt 42 in seated relationship with respect to the clevis.

A schematic diagram of the hydraulic system for operating the front blade 12 and the rear blade 16 is shown in FIG. 5. Pressurized hydraulic fluid from a source of pressurized hydraulic fluid 50 is in communication with a first three-way valve 52, which may be selectively positioned by a solenoid 54 or the like. The hydraulic fluid communicates from the valve 52 to one longitudinal end 56 of the hydraulic cylinder or to the other longitudinal end 58 of the same hydraulic cylinder. By selectively positioning the valve 52, the front blade 12 may be raised, lowered, or maintained in a selected vertical position. In conventional snow plow assemblies utilizing only a front blade, a similar, separate three-way valve is used to control the angle of the front blade. The snow plow assembly of the present invention also uses a second three-way valve 60 in fluid communication with the source 50 of pressurized hydraulic fluid. Again, the second three-way valve 60 may be operable by a solenoid 62 or the like. Depending upon the position of the second three-way valve 60, the pressurized hydraulic fluid may pass through one of either two lines in communication with a two-way valve 64, which also may be activated by a solenoid 66 or the like. The snow plow assembly also includes a pair of second and third two-way valves 68, 70 that are concurrently operable by a solenoid 72 or the like. Depending upon the position of the first two-way valve 64, the pressurized hydraulic fluid may pass through the second or third two-way valves 68, 70. It should be appreciated from FIG. 5 that by appropriately positioning both the second three-way valve 60, the first two-way valve 64, and the second and third two-way valves 68, 70, pressurized hydraulic fluid can be made to communicate selectively with either one longitudinal end 74 or the other longitudinal end 76 of a hydraulic ram used to angle the front blade 12 or to one longitudinal end 78 or the other longitudinal end 80 of a hydraulic cylinder in the hydraulic ram 48 used to raise and lower the rear blade 16 or to one longitudinal end 82 or the other longitudinal end 84 of the hydraulic cylinder in the hydraulic ram 34 used to tilt the pitch of the rear blade 16. It should be appreciated further that the second three-way valve 60 may be appropriately positioned to maintain the angle of the front blade 12, to maintain the vertical position of the rear blade 16, and to maintain the pitch of the rear blade 16 in selected positions.

FIG. 6 is a schematic top view of a control panel used to activate and position the first three-way valve 52, the second three-way valve 60, the two-way valve 64, and the pair of two-way valves 68, 70. The control panel includes four toggle switches, 86, 88, 90, and 92. The toggle switch 86 controls the solenoid 54, which controls the position of the first three-way valve 52. When the toggle switch 86 is in a vertical position, the first three-way valve 52 is in the position depicted in FIG. 5, which simply maintains the front blade 12 at a selected vertical position. The toggle switch 76 may be pivoted upwardly or downwardly as depicted by the arrows in FIG. 6, which will correspondingly move the first three-way valve 52 in a manner which will either raise or lower the front blade 12. The toggle switch 90 activates the solenoid 66, which in turn positions the two-way valve 64. The toggle switch 92 activates the solenoid 721 which in turn concurrently activates the pair of two-way valves 68, 70. When the toggle switch 90 is in a vertical position, the toggle switch 88 operates the angle of the front blade 12. When the toggle switch 90 is pivoted downwardly in the direction of the arrow indicated in FIG. 6 and the toggle switch 92 is in a vertical position, then the toggle switch 88 operates the raising and lowering of rear blade 16. When the toggle switch 90 is pivoted downwardly and the toggle switch 92 is pivoted downwardly in the direction of the corresponding arrows in FIG. 6, then the toggle switch 88 operates the tilting of the pitch of the rear blade 16.

It should be appreciated that some or all of the two-way valves could be placed in communication with the first three-way valve 52 so that the position of the toggle switch 86 either raises, lowers or maintains the vertical position of the rear blade 16 or tilts the pitch of the rear blade 16. It should be further appreciated that the hydraulic system of the present invention permits the rear blade to be retrofitted easily into the existing hydraulic system for conventional front blade.

Since the rear blade 16 is pivotably connected at five individual points to the mounting plate 16, the rear blade 16 is firmly and strongly attached to the pick-up truck 10. The hydraulic ram 48 may be extended to such a degree that the rear blade 16 presses against the ground, whereby continued extension of the hydraulic ram 48 causes the rear end of the pick-up truck 10 to raise off the ground so that the rear wheels of the pick-up truck 10 do not support the pick-up truck 10. The wear plate 24 attached to the central upstanding section 18 of the rear blade 16 is beveled to minimize the possibility that the rear blade will bite into the ground in this condition. The weight of the rear blade 16 as well as the partial weight of the truck on the wear plate 24 permits a tremendous scrapping capability in this condition (when used with a front wheel drive or four wheel drive vehicle).

It should also be appreciated that the rear blade 16, the mounting rods 28, 32, the telescoping rod and tube assembly 30, and the hydraulic ram 34 may be disattached from the vehicle, a trailer hitch may be mounted on the distal end of the hydraulic ram 48, and the hydraulic ram 48 may be utilized for easy attachment to a trailer for hauling the trailer by the pick-up truck 10.

The snow plow assembly of the present invention can be used for removing snow from driveways which terminate at one end at a garage and at the other end at a road. First, the vehicle is backed in a rearward direction along the driveway toward the garage while the front blade and the rear blade are each in a relatively raised position substantially above the snow on the driveway. The vehicle is stopped, and the rear blade is lowered such that it depends into the snow on the driveway. The vehicle is then driven in a forward direction along the driveway toward the road such that the rear blade pulls snow from behind the vehicle. When the vehicle approaches the road, it will be appreciated that the driver is in a relatively favorable position to ascertain the condition of traffic on the road and to determine whether it is safe to continue from the driveway onto the road. The vehicle is steered onto the road, and the rear blade is raised, whereby the snow is deposited in a pile at the end of the driveway. The vehicle is then maneuvered so that it is facing the deposited snow pile, and then the front blade is lowered. The vehicle is moved toward the snow pile such that the front blade deflects the snow in the snow pile along the side of the curb of the property from which the snow is removed, downstream from the driveway.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

I claim:

1. A method of plowing snow from a snow covered driveway terminating at one end at a garage and at the other end at a road, the junction of the driveway and the road having an upstream corner and a downstream corner, comprising the steps:

providing a vehicle having a front blade mounted on the front of said vehicle and adapted to push snow out of the path of said vehicle when said vehicle is travelling in a forward direction;

means for mounting said front blade on the front of said vehicle;

means for altering the position of said front blade and for maintaining said front blade in a selected position relative to said vehicle;

a rear blade mounted on the rear of said vehicle and adapted to pull snow from behind said vehicle when said vehicle is travelling in a forward direction;

means for mounting said rear blade on the rear of said vehicle;

means for selectively altering the position of said rear blade and for maintaining said rear blade in a selected position relative to said vehicle;

means for rendering said first blade position altering means inoperative when said rear blade position altering means is operative and for rendering said rear blade position altering means inoperative when said front blade position altering means is operative; and a source of pressurized hydraulic fluid wherein said front blade position altering means and said rear blade position altering means are each in fluid communication with said pressure source and are each operative in response to said pressurized hydraulic fluid and wherein said rendering means comprises a switch for selectively diverting said pressurized fluid between said front blade position altering means and said rear blade position altering means;

backing said vehicle in a rearward direction along the driveway toward the garage while said front blade and said rear blade are each in a relatively raised position substantially above the snow on the driveway;

stopping said vehicle near the garage;

lowering said rear blade by said rendering means such that said rear blade depends into the snow on the driveway;

driving said vehicle in a forward direction along the driveway toward the road such that said rear blade pulls snow from behind said vehicle;

steering said vehicle onto the road;

raising said rear blade by said rendering means such that the snow pulled by said rear blade is deposited at the end of the driveway near the road and forms a snow pile;

moving said vehicle such that the front of said vehicle substantially faces the snow pile;

lowering said front blade by said rendering means such that said front blade is substantially adjacent to the ground; and driving said vehicle in a forward direction toward the snow pile such that said front blade pushes snow in the snow pile toward the downstream corner of the junction between the driveway and the road.

2. A snow plow assembly adapted for mounting on a vehicle comprising:

a front blade adapted to be mounted on the front of said vehicle and adapted to push snow out of the path of said vehicle then said vehicle is travelling in a forward direction;

means for mounting said front blade on the front of said vehicle;

means for raising and lowering said front blade and for maintaining said front blade in a selected vertical position relative to said vehicle;

means for altering the angle of said front blade in a substantially horizontal plane relative to the front of said vehicle and for maintaining said front blade at a selected angle;

a rear blade adapted to be mounted on the rear of said vehicle and adapted to pull snow from behind said vehicle when said vehicle is travelling in a forward direction;

means for mounting said rear blade on the rear of said vehicle, said rear blade mounting means comprising at least five elongated support members each of which is pivotably mounted at one end thereof to the rear end of the vehicle and each of which is pivotably mounted at the opposite end thereof to said rear blade;

means for raising and lowering said rear blade and for maintaining said rear blade in a selected vertical position relative to said vehicle; and means for tilting the pitch of said rear blade and for maintaining said rear blade at a selected pitch.

3. A snow plow assembly adapted for mounting on a vehicle comprising:

a front blade adapted to be mounted on the front of said vehicle and adapted to push snow out of the path of said vehicle when said vehicle is travelling in a forward direction;

means for mounting said front blade on the front of said vehicle;

means for selectively altering the position of said front blade and for maintaining said front blade in a selected position relative to said vehicle;

a rear blade adapted to be mounted on the rear of said vehicle and adapted to pull snow from behind said vehicle when said vehicle is travelling in a forward direction;

means for mounting said rear blade on the rear of said vehicle, said rear blade mounting means comprising at least five elongated support members each of which is pivotably mounted at one end thereof to the rear end of the vehicle and each of which is pivotably mounted at the opposite end thereof to said rear blade;

means for selectively altering the position of said rear blade and for maintaining said rear blade in a selected position relative to said vehicle; and means for rendering said front blade position altering means inoperative when said rear blade position altering means is operative and for rendering said rear blade position altering means inoperative when said front blade position altering means is operative.

4. A snow plow assembly according to claim 3 wherein said rear blade position altering means comprises means for raising and lowering said rear blade and for maintaining said rear blade at a selected vertical position.

5. A snow plow assembly according to claim 3 wherein said rear blade position altering means comprises means for tilting the pitch of said rear blade and for maintaining said rear blade at a selected pitch.

6. A snow plow assembly according to claim 4 wherein said rear blade position altering means comprises means for tilting the pitch of said rear blade and for maintaining said rear blade at a selected pitch.

7. A snow plow assembly according to claim 4 wherein the vehicle possesses a pair of front wheels and a pair of rear wheels and wherein said rear blade and said rear blade mounting means are sufficiently sturdy and said rear blade raising and lowering means is capable of sufficiently powerfully lowering said rear blade such that the rear wheels of the vehicle substantially fail to provide support for the vehicle and such that the rear of the vehicle is supported by said rear blade, said rear blade mounting means, and said rear blade raising and lowering means.

8. A snow plow assembly adapted for mounting on a vehicle comprising:

a front blade adapted to be mounted on the front of said vehicle and adapted to push snow out of the path of said vehicle when said vehicle is travelling in a forward direction, means for mounting said front blade on the front of said vehicle;

means for selectively altering the position of said front blade and for maintaining said front blade in a selected position relative to said vehicle;

a rear blade adapted to be mounted on the rear of said vehicle and adapted to pull snow from behind said vehicle when said vehicle is travelling in a forward direction;

means for mounting said rear blade on the rear of said vehicle;

means for selectively altering the position of said rear blade and for maintaining said rear blade in a selected position relative to said vehicle;

means for rendering said front blade position altering means inoperative when said rear blade position altering means is operative and for rendering said rear blade position altering means inoperative when said front blade position altering means is operative; and a source of pressurized hydraulic fluid wherein said front blade position altering means and said rear blade position altering means are each in fluid communication with said pressure source and are each operative in response to said pressurized hydraulic fluid and wherein said rendering means comprises a switch for selectively diverting said pressurized fluid between said front blade position altering means and said rear blade position altering means.

9. A snow plow assembly according to claim 8 wherein said front blade position altering means comprises means for raising and lowering said front blade and for maintaining such front blade at a selected vertical position.

10. A snow plow assembly according to claim 8 wherein said front blade position altering means comprises means for altering the angle of said front blade in a substantially horizontal plane and for maintaining said front blade at a selected angle.

11. A snow plow assembly according to claim 8 wherein said rear blade position altering means comprises means for raising and lowering said rear blade and for maintaining said rear blade at a selected vertical position.

12. A snow plow assembly according to claim 9 wherein said rear blade position altering means comprises means for raising and lowering said rear blade and for maintaining said rear blade at a selected vertical position.

13. A snow plow assembly according to claim 10 wherein said rear blade position altering means comprises means for raising and lowering said rear blade and for maintaining said rear blade at a selected vertical position.

14. A snow plow assembly according to claim 8 wherein said rear blade position altering means comprises means for tilting the pitch of said rear blade and for maintaining said rear blade at a selected pitch.

15. A snow plow assembly according to claim 9 wherein said rear blade position altering means comprises means for tilting the pitch of said rear blade and for maintaining said rear blade at a selected pitch.

16. A snow plow assembly according to claim 10 wherein said rear blade position altering means comprises means for tilting the pitch of said rear blade and for maintaining said rear blade at a selected pitch.

17. A snow plow assembly according to claim 8 wherein said front blade position altering means is operable independently of the operability of said rear blade position altering means.

18. A snow plow assembly according to claim 11 wherein the vehicle possesses a pair of front wheels and a pair of rear wheels and wherein said rear blade and said rear blade mounting means are sufficiently sturdy and said rear blade raising and lowering means is capable of sufficiently powerfully lowering said rear blade such that the rear wheels of the vehicle substantially fail to provide support for the vehicle and such that the rear of the vehicle is supported by said rear blade, said rear blade mounting means, and said rear blade raising and lower means.

19. A snow plow assembly according to claim 1 wherein said rear blade mounting means comprises at least five elongated support members each of which is pivotably mounted at one end thereof to the rear end of the vehicle and each of which is pivotably mounted at the opposite end thereof to said rear blade.

* * * * *